US005376912A

United States Patent [19]

Casagrande

[11] Patent Number: 5,376,912

[45] Date of Patent: Dec. 27, 1994

[54] COMBINED TRANSFORMER AND INDUCTOR

[76] Inventor: Serge Casagrande, 1318 Norwick Dr., Land O' Lakes, Fla. 33549

[21] Appl. No.: 849,949

[22] Filed: Mar. 12, 1992

[51] Int. Cl.[5] ..... H01F 17/06

[52] U.S. Cl. ..... 336/178; 336/212

[58] Field of Search ..... 323/355, 361, 362; 336/55, 61, 178, 212

[56] References Cited

U.S. PATENT DOCUMENTS

| | | | |
|---|---|---|---|
| 2,792,556 | 5/1957 | Oglesbee | 336/178 |
| 3,426,305 | 2/1969 | Keble | 336/178 |
| 3,437,965 | 4/1969 | Ragsdale | 336/61 |
| 4,613,841 | 9/1986 | Roberts | 336/178 |
| 4,689,592 | 8/1987 | Walker | 336/212 |
| 4,956,626 | 9/1990 | Hoppe et al. | 336/61 |

FOREIGN PATENT DOCUMENTS

| | | | |
|---|---|---|---|
| 253617 | 4/1967 | Austria | 336/178 |
| 2037089 | 7/1980 | United Kingdom | 336/178 |

*Primary Examiner*—Jeffrey L. Sterrett
*Attorney, Agent, or Firm*—Frijouf, Rust & Pile

[57] ABSTRACT

An apparatus is disclosed for a combined transformer and inductor for transmitting power between a source and a load. The apparatus comprises a transformer core and an inductor core which are magnetically independent from one another. A primary winding is wound about the transformer core and is electrically connected to the source by a primary connector. A secondary winding is wound about the transformer core and is electrically connected to the load by a secondary connector. An inductor coil is wound about the inductor core and is interposed in series with one of the primary and the secondary windings. A plurality of air gaps are interposed in the inductor core for providing an inductance in one of the primary and secondary windings. The air gaps are uniformly distributed about the inductor core for uniformly distributing heat generated at the air gaps about the inductor core.

13 Claims, 7 Drawing Sheets

COMBINED TRANSFORMER AND INDUCTOR

BACKGROUND OF THE INVENTION

FIELD OF THE INVENTION

This invention relates to electrical transformers and more specifically to a combined transformer and inductor for use in high-power applications operating at low frequencies or high frequencies.

INFORMATION DISCLOSURE STATEMENT

Electrical transformers have been widely used to transfer electrical energy between a source and a load circuit by employing a magnetic field which links the source and the load circuits. Electrical transformers have been used for changing voltage, matching impedances and isolating circuits.

For many of these applications, an inductance was required to ensure proper operation of the circuit. Accordingly, it was necessary to add a separate inductor to the circuit. The separate inductor added circuitry, weight, cost and complexity to the device.

This problem was solved in the prior art by combining the transformer and inductor in a single unit. Typically, a core element was provided with an air gap enabling an inductive winding to be wound around a core element with the air gap. The transformer primary and secondary windings were wound about a continuous core element having no air gap.

These improvements greatly enhanced the art of transformer construction for circuits requiring an inductance. The advantage of combining the transformer and inductor was to eliminate the need for two separate mountings and for combining the transformer windings and the inductance windings on a single transformer and inductor frame. This resulted in a reduction in weight and material costs in combined units.

These prior art combined transformers and inductors have been widely and effectively used for low power applications. However, the combined transformers and inductors disclosed in the prior art are not well suited for high power applications. Further complications arose when the prior art combined transformers and inductors operate at high power levels and at high frequencies. This power limitation is related to heat dissipation.

The air gap in the inductance core substantially increases the reluctance of the magnetic flux through the air gap. Accordingly, a substantial amount of heat was generated proximate to the air gap. So long as the combined transformer and inductor was limited to low power applications, the generation of heat in the air gap did not excessively heat the inductance core or the transformer core. At high frequencies, the skin effect will cause excessive heat to be generated thus degrading the components of the combined transformer and inductor as well as other nearby electronic components.

With the advent of higher power level switching circuits, such as series resonant and parallel resonant circuits, there arose a need for a combined transformer and inductor capable of operating at high power levels. Merely increasing the scale of the prior art designs by making cores and coils larger was not a viable solution. The heat generated in a high power application would quickly destroy the combined transformer and inductor. At high frequencies and at high power levels, the prior art combined transformers and inductors provided excessively high leakage flux and excessively high heat generation.

Another reason that the prior art is not well suited for high power applications involves the difficulty of calculating fringing leakage flux in large gaps. By merely enlarging prior art combined transformer and inductor designs for high power applications, the air gap in the inductor core becomes excessively large causing an increase in the fringing and leakage flux. As the gap becomes larger, the calculations for the losses across the gap become less accurate. This creates greater difficulty in accurately designing a combined transformer and inductor.

Accordingly, the prior art designs have been satisfactory for low power combined transformers and inductors but have not been satisfactory for high power and high frequency applications such as series or parallel resonant inverters. Unfortunately, these problems cannot be solved by merely enlarging the prior art designs.

The present invention overcomes the aforementioned inadequacies of the prior art by providing a new design which allows for the more rapid dissipation of heat and allows for the more accurate calculation of flux and thereby improving design specifications.

Therefore, it is an object of the present invention to provide an improved combined transformer and inductor which reduces the heat generated in high power and high frequency applications.

Another object of this invention is to provide an improved combined transformer and inductor which is capable of operating at various frequencies from several hertz to the radio frequency range.

Another object of this invention is to provide an improved combined transformer and inductor which is capable of operating at various power levels from several watts to thousands of kilowatts.

Another object of this invention is to provide an improved combined transformer and inductor which distributes heat in the inductor core more uniformly than in prior designs.

Another object of this invention is to provide an improved combined transformer and inductor which dissipates heat in the inductor core more rapidly than in prior designs.

Another object of this invention is to provide an improved combined transformer and inductor which reduces leakage flux in the inductor core.

Another object of this invention is to provide an improved combined transformer and inductor which allows more accurate design calculations.

Another object of this invention is to provide an improved combined transformer and inductor which limits the losses at each of a plurality of air gaps of the inductor to be less than 2.0 watts per square inch for an air cooled inductor.

Another object of this invention is to provide an improved combined transformer and inductor which limits the losses at each of a plurality of air gaps of the inductor to be less than 30.0 watts per square inch for a water cooled inductor.

Another object of this invention is to provide an improved combined transformer and inductor which limits the losses at each of a plurality of air gaps of the inductor to be less than 0.25 inches.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention within the scope of the invention. Accordingly other objects in a full under standing of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved combined transformer and inductor for transmitting power between a source and a load. The apparatus comprises a transformer core and an inductor core which are magnetically independent from one another. A primary winding is wound about the transformer core and is electrically connected to the source by a primary connector. A secondary winding is wound about the transformer core and is electrically connected to the load by a secondary connector. An inductor coil is wound about the inductor core and is interposed in series with one of the primary and the secondary windings. A plurality of air gaps are interposed in the inductor core for providing an inductance in one of the primary winding and the secondary windings. Preferably, the air gaps are uniformly distributed about the inductor core for uniformly distributing heat generated at the air gaps about the inductor core.

In a more specific embodiment of the invention, the inductor coil is unitarily wound with one of the primary and the secondary windings. In one embodiment, the inductor coil is interposed in series with the primary winding whereas in another embodiment, the inductor coil is interposed in series with the secondary winding. In another embodiment, a first and a second inductor coil are respectively interposed within the primary and the secondary windings.

The air gaps are interposed at equal distances about the inductor core with each of the air gaps having a uniform gap length. The inductor coil is wound about the inductor core to avoid overlying any air gap. Each of the air gaps has an air gap length, and a gap flux and a leakage flux across each air gap. The air gaps are of a sufficient number to limit the air gap length to less than 0.25 inches.

The apparatus includes cooling means for cooling the inductor core comprising a water-cooled jacket in thermal contact with the inductor core. The water-cooled jacket further comprises a first and a second water-cooled plate disposed on a first and a second side of the inductor core.

In a more specific embodiment of the invention, the primary winding and secondary winding are wound in a continuous magnetic path about the transformer core. One of the primary and secondary windings is wound in a continuous magnetic path about the inductor core. The continuous magnetic path about the inductor core is disposed in a stacked relationship with the continuous magnetic path about the transformer core and is magnetically independent therefrom. The air gaps are uniformly distributed in the continuous magnetic path about the inductor core for providing the inductance in one of the primary and the secondary windings and for uniformly distributing heat generated at the air gaps about the continuous magnetic path inductor core. The plurality of air gaps divide the continuous magnetic path inductor core into a plurality of sectors. The primary and secondary windings comprise a plurality of turns. At least one of the primary and secondary windings is wound about the continuous magnetic path inductor core to avoid overlying each of the plurality of air gaps, and so that an equal number of the plurality of turns is wound about each of the plurality of sectors.

In one embodiment of the invention, the continuous magnetic path transformer core and the continuous magnetic path inductor core are toroidal. The stacked relationship of the continuous magnetic path inductor core and the continuous magnetic path transformer core forms a cylindrical core stack. Cooling means cools the cylindrical core stack. The cooling means comprise a water cooled jacket in thermal contact with the cylindrical core stack. The water cooled jacket comprises a first and a second water-cooled plate disposed on a first and a second side of the cylindrical core stack. The water cooled jacket further comprises a cylindrical wrap disposed on a cylindrical surface of the cylindrical core stack.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
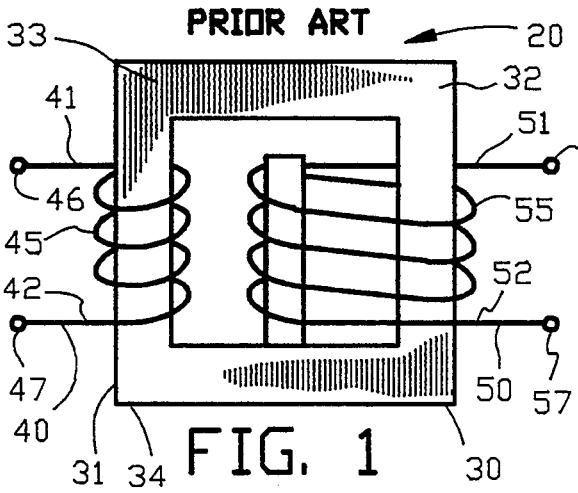
FIG. 1 is a representation of a transformer and inductor as shown by the prior art.

FIG. 1 is a diagrammatic representation of a transformer 20 which provides inductance as well known in the prior art. The transformer 20 comprises a core 30 constructed of a ferrite or other material having high magnetic permeability. In this embodiment, the core 30 has an E-I shape and comprises a first, second, third, fourth and fifth leg 31, 32, 33, 34 and 35, respectively. An air gap 36 is interposed between the fifth leg 35 and the third leg 33. A source conductor 40 comprises a primary winding 45 wound around the first leg 31 of the core 30. A first end 41 of a source conductor 40 is connected to a first source terminal 46. A second end 42 of the source conductor 40 is connected to a second source terminal 47. The first and second source terminals 46 and 47 are connected to an electrical power source (not shown). A load conductor 50 comprises a secondary winding 55 wound around the second leg 32 and the fifth leg 35 of the core 30. A first end 51 of the load conductor 50 is connected to a first load terminal 56. A second end 52 of the load conductor 50 is connected to a second load terminal 57. The first and second load terminals 56 and 57 are connected to an electrical load (not shown).

Figure 2:
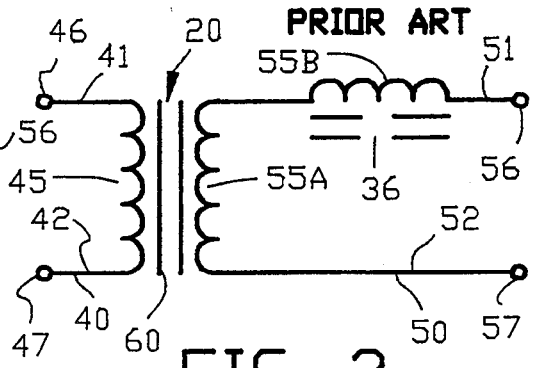
FIG. 2 is a circuit diagram of FIG. 1.

FIG. 2 is a circuit diagram of the prior art transformer 20 shown in FIG. 1. The source conductor 40 comprises primary winding 45 whereas the load conductor 50 comprises a secondary transformer winding 55A and a secondary inductor winding 55B. It is understood that the secondary transformer winding 55A and the secondary inductor winding 55B shown in FIG. 2 are in physical reality one and the same as the secondary winding 55 shown in FIG. 1. The secondary transformer winding 55A is that portion of the secondary winding 55 of FIG. 1 which is wound about the transformer core 60. The secondary inductor winding 55B is that portion of the secondary winding 55 which is wound about the inductor core 61.

A transformer core 60, represented as two solid parallel lines in FIG. 2, comprises the first, second, third and fourth legs 31–34 of the core 30. The transformer core 60 is that portion of the core 30 which magnetically links and around which is wound the primary winding 45 and the secondary transformer winding 55A. An inductor core 61, represented as two broken parallel lines in FIG. 2, at least partially comprises the fifth leg 35 of the core 30. The air gap 36 is represented as a discontinuity in the broken parallel lines. It should be observed that the transformer core 60 and the inductor core 61 are magnetically connected.

Figure 3:
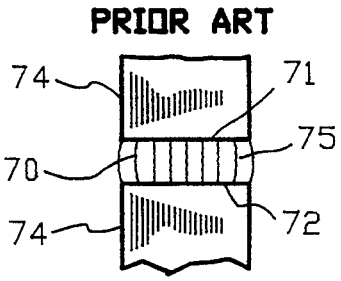
FIG. 3 is a representation of a small air gap in a transformer core exhibiting little fringing flux across the air gap.

FIG. 3 illustrates a ferromagnetic core 74 having a first face 71 and a second face 72 with small air gap 70 interposed therebetween. Magnetic flux 75 flows across the small air gap in a direction substantially perpendicular to the first and second faces 71 and 72.

Figure 4:
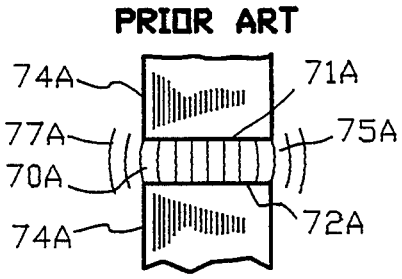
FIG. 4 is a representation of a large air gap in a transformer core, exhibiting large fringing flux across the air gap.

FIG. 4 illustrates ferromagnetic core 74A having a first face 71A and a second face 72A with a large air gap 70A interposed therebetween. Magnetic flux 75A flows across the large air gap in a direction substantially perpendicular to the first and second faces 71A and 72A. The magnetic flux 75A includes a fringing flux 77A which extends external to the large air gap 70A and is non-parallel relative to the parallel lines of magnetic flux 75A.

Figure 5A:
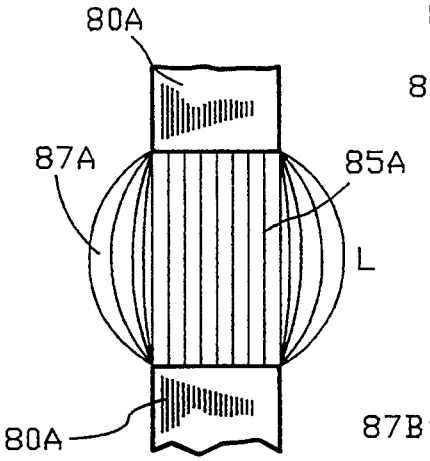
FIG. 5A is a representation of a large air gap exhibiting a substantial fringing flux.
Figure 5B:
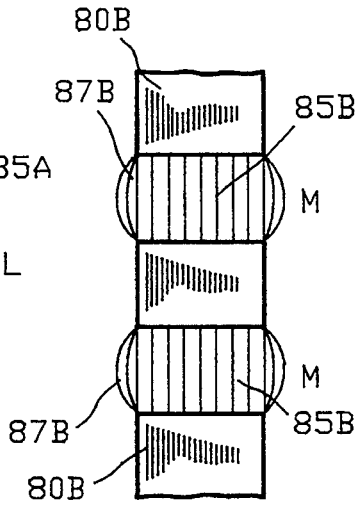
FIG. 5B is a representation of two medium air gaps exhibiting a moderate fringing flux.
Figure 5C:
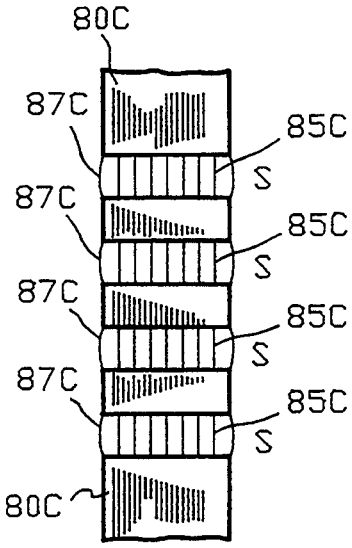
FIG. 5C is a representation of four small air gaps exhibiting negligible fringing flux.

FIGS. 5A–5C illustrate ferromagnetic cores 80A–80C having the same equivalent air gaps 81A–81C, respectively. The air gap 81A is contained in a single large air gap whereas the air gaps 81B is distributed over two medium air gaps. The air gap 81C is distributed over four small air gaps.

In FIG. 5A, the magnetic flux 85A flows across the single large air gap in a substantially parallel direction with a fringing flux 87A extending external to large air gap 81A and is bowed outward relative to the parallel magnetic flux 85A. The fringing flux 87A is substantial relative to magnetic flux 85A.

In FIG. 5B, the magnetic flux 85B flows across each of the medium air gaps 81B in a substantially parallel direction with a fringing flux 87B extending external to the medium air gaps 81B and is bowed outward relative to the parallel magnetic flux 85B. The fringing flux 87B is only moderate relative to the magnetic flux 85B.

In FIG. 5C, the magnetic flux 85C flows across each of the small air gaps in a substantially parallel direction. The fringing flux 87C is negligible relative to the magnetic flux 85C. FIGS. 5A–5C illustrate that the fringing effects of an air gap cap be substantially reduced by distributing the air gap length over a plurality of smaller air gap lengths.

Figure 6:
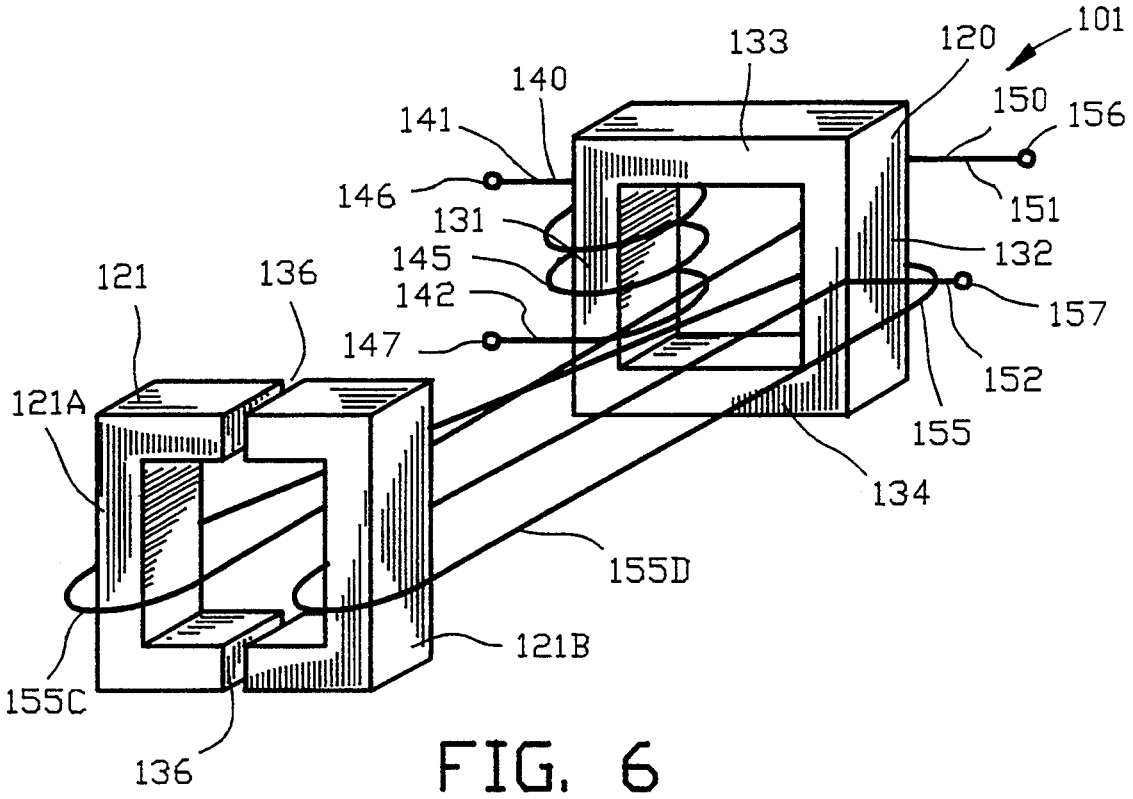
FIG. 6 is a diagrammatic representation of a first embodiment of a combined transformer and inductor of the present invention with the inductor coil disposed in the secondary winding.
Figure 6A:
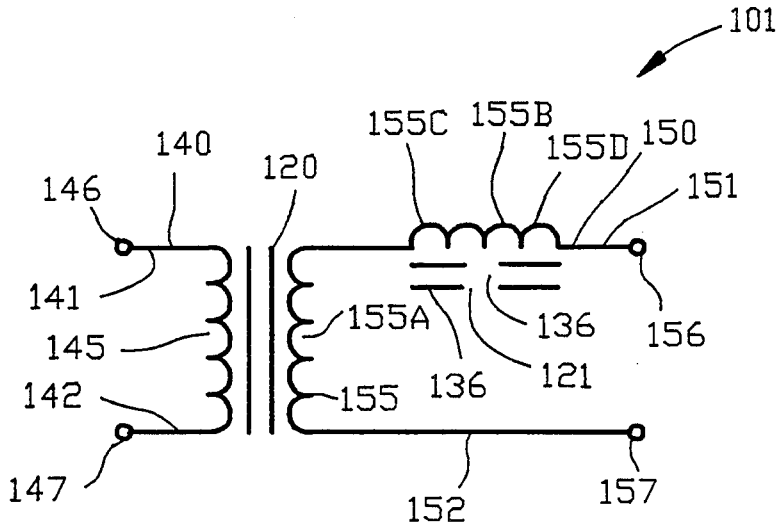
FIG. 6A is a circuit diagram of FIG. 6.
Figure 7:
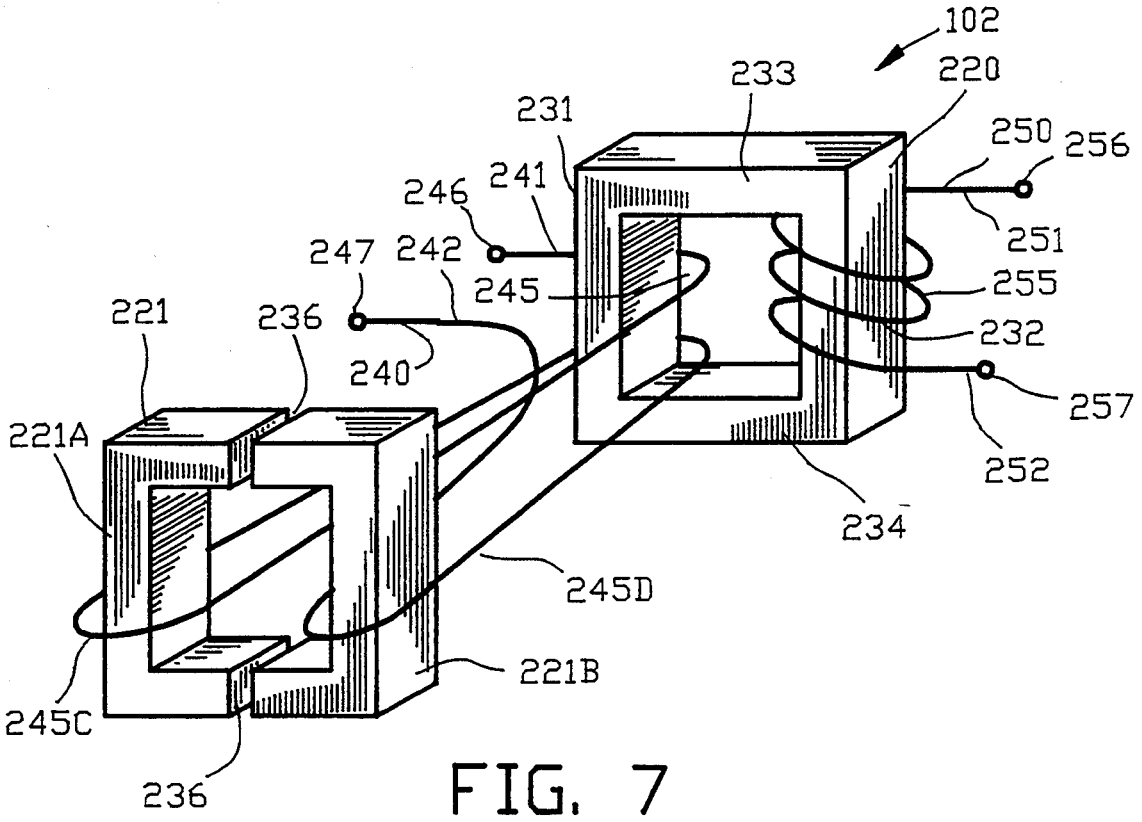
FIG. 7 is a diagrammatic representation of a second embodiment of a combined transformer and inductor of the present invention with the inductor coil disposed in the primary winding.
Figure 7A:
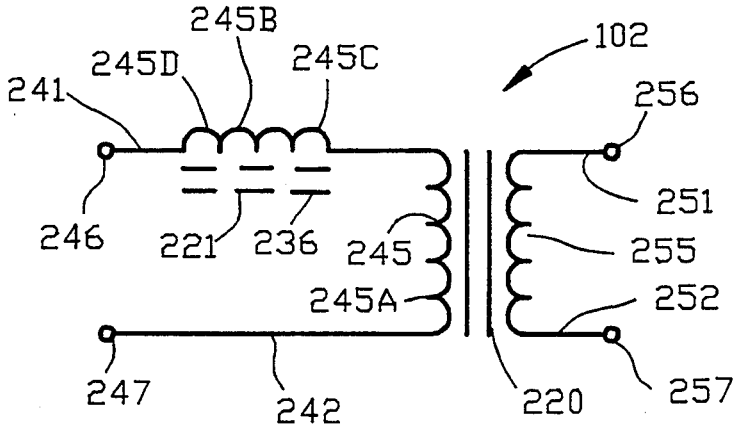
FIG. 7A is a circuit diagram of FIG. 7.
Figure 8:
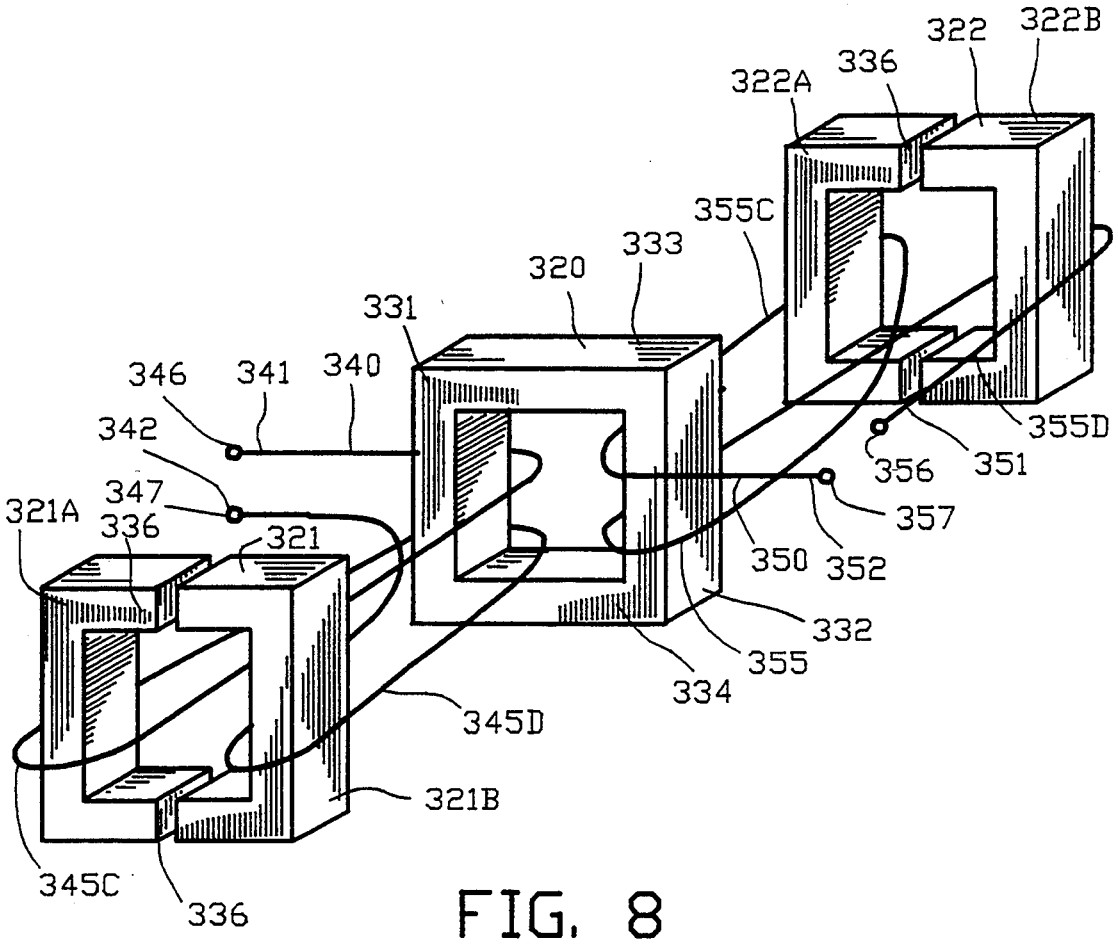
FIG. 8 is a diagrammatic representation of a third embodiment of a combined transformer and inductor of the present invention with the inductor coil disposed in the primary and the secondary windings.
Figure 8A:
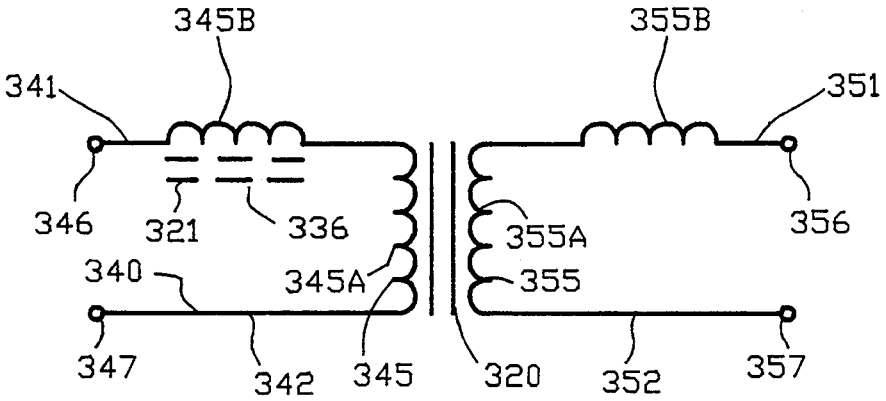
FIG. 8A is a circuit diagram of FIG. 8.

FIGS. 6–8 are diagrammatic representations showing a first, second and a third embodiment of a combined transformer and inductor of the present invention. FIGS. 6A–8A illustrate circuit diagrams of the first, second and third embodiments of the combined transformer and inductor of the present invention. FIGS. 6 and 6A depict the combined transformer and inductor 101 having an inductance in the secondary winding. FIGS. 7 and 7A depict the combined transformer and inductor 102 having an inductance in the primary winding. FIGS. 8 and 8A depict the combined transformer and inductor 103 having an inductance in both the primary winding and the secondary winding.

As shown in FIG. 6, the combined transformer and inductor 101 comprises a transformer core 120 and an inductor core 121, each being composed of ferrous or other material having high magnetic permeability. The transformer core 120 has a square shape, and comprises a first, second, third, and fourth leg, 131–134, respectively. It is understood that the transformer core 120 may also comprise other structural designs as known in the art. The Inductor core 121 comprises a first and a second sector 121A and 121B but may also comprise other structural designs as known in the art. Two air gaps 136 are interposed in inductor core 121 between first and second sector 121A and 121B. The transformer core 120 and the inductor core 121 are magnetically independent, having no magnetic coupling therebetween, unlike the prior art device shown in FIG. 1.

A source conductor 140 comprises a primary winding 145 wound around the first leg 131 of the transformer core 120. A first end 141 of the source conductor 140 is connected to a first source terminal 146. A second end 142 of the source conductor 140 is connected to a second source terminal 147. The first and second source terminals 146 and 147 are connected to an electrical power source (not shown). A load conductor 150 comprises a secondary winding 155 wound around the second leg 132 of the transformer core 120 and around the inductor core 121.

The secondary winding 155 comprises a first loop 155C wound around the second leg 132 of the transformer core 120 and around the first sector 121A of the inductor core 121. The secondary winding 155 also comprises a second loop 155D wound around the second leg 132 of the transformer core 120 and around the second sector 121B of the inductor core 121. A first end 151 of the load conductor 150 is connected to a first load terminal 156. A second end 152 of the load conductor 150 is connected to a second load terminal 157. The first and second load terminals 156 and 157 are connected to an electrical load (not shown).

FIG. 6A is a circuit diagram of the combined transformer and inductor 101 shown in FIG. 6. The source conductor 140 comprises primary winding 145 whereas the secondary winding 155 comprises a secondary transformer winding 155A and a secondary inductor winding 155B. It is understood that the secondary transformer winding 155A and the secondary inductor winding 155B shown in FIG. 6A are in physical reality one and the same as secondary winding 155 comprising the first and second loops 155C and 155D shown in FIG. 6. The secondary transformer winding 155A is that portion of the secondary winding 155 which is wound about the transformer core 120. The secondary inductor winding 155B is that portion of the secondary winding 155 which is wound about the inductor core 121. The transformer core 120 is represented as two solid parallel lines in FIG. 6A whereas the inductor core 121 is represented as two broken parallel lines in FIG. 6A. The air gaps 136 are represented as a discontinuity in the broken parallel lines.

FIG. 6A electrically shows primary winding 145 and secondary transformer winding 155A linked through transformer core 120 and with the secondary inductor winding 155B wound around the inductor core 121 having the air gaps 136. The primary winding 145 is wound on the transformer core 120 only, while the first and second loops 155C and 155D of the secondary winding 155 are wound on both of the transformer core 120 and the inductor core 121. Accordingly, the combined transformer and inductor 101 of FIGS. 6 and 6A has the inductance in secondary winding 155.

As shown in FIG. 7, the combined transformer and inductor 102 comprises a transformer core 220 and an inductor core 221 with the transformer core 220 comprising a first, second, third, and fourth leg, 231–234, respectively. The Inductor core 221 comprises a first and a second sector 221A and 221B with two air gaps 236 being interposed in the inductor core 221 between first and second sectors 221A and 221B. The transformer core 220 and the inductor core 221 are magnetically independent, having no magnetic coupling therebetween, unlike the prior art device shown in FIG. 1.

A source conductor 240 comprises a primary winding 245 wound around the first leg 231 of the transformer core 220. A first end 241 of the source conductor 240 is connected to a first source terminal 246. A second end 242 of the source conductor 240 is connected to a second source terminal 247. The first and second source terminals 246 and 247 are connected to an electrical power source (not shown). A load conductor 250 comprises a secondary winding 255 wound around the second leg 232 of the transformer core 220.

The primary winding 245 is wound around both first leg 231 of the transformer core 220 and the inductor core 221. The primary winding 245 comprises a first loop 245C wound around the first leg 231 of the transformer core 220 and around the first sector 221A of the inductor core 221. The primary winding 245 also comprises a second loop 245D wound around the first leg 231 of the transformer core 220 and around the second sector 221B of the inductor core 221. The secondary winding 255 is wound around the second leg 232 of the transformer core 220 only.

FIG. 7A is a circuit diagram of the combined transformer and inductor 102 shown in FIG. 7. The primary winding 245 comprises a primary transformer winding 245A and a primary inductor winding 245B. It is understood that the primary transformer winding 245A and the primary inductor winding 245B shown in FIG. 7A are in physical reality one and the same as the primary winding 245 comprising the first and second loops 245C and 245D shown in FIG. 7. The primary transformer winding 245A is that portion of the primary winding 245 which is wound about the transformer core 220. The primary inductor winding 245B is that portion of the primary winding 245 which is wound about the inductor core 221. The load conductor 250 comprises the secondary winding 255. As such, FIG. 7A electrically shows primary transformer winding 245A and the secondary winding 255 linked through transformer core 220 and the primary inductor winding 245B wound around the inductor core 221.

The first and second loops 245C and 245D of the primary winding 245 are wound on both the transformer core 220 and the inductor core 221, while the secondary winding 255 is wound on the transformer core 220 only. Accordingly, the combined transformer and inductor 102 of FIGS. 7 and 7A has the inductance in the primary winding 255.

As shown in FIG. 8, the combined transformer and inductor 103 comprises a transformer core 320 and a first inductor core 321 and a second inductor core 322. The transformer core 320 comprises a first, second, third, and fourth leg, 331–334, respectively. The first inductor core 321 comprises a first and a second sector 321A and 321B with two air gaps 336 being interposed in the first inductor core 321 between the first and second sectors 321A and 321B. The second inductor core 322 comprises a first and a second sector 322A and 322B with two air gaps 336 being interposed in the second inductor core 322 between the first and second sectors 322A and 322B. The transformer core 320 and the first and second inductor cores 321 and 322 are magnetically independent, having no magnetic coupling therebetween, unlike the prior art device shown in FIG. 1.

A source conductor 340 comprises a primary winding 345 wound around the first leg 331 of the transformer core 320. A first end 341 of the source conductor 340 is connected to a first source terminal 346. A second end 342 of the source conductor 340 is connected to a second source terminal 347. The first and second source terminals 346 and 347 are connected to an electrical power source (not shown). A load conductor 350 comprises a secondary winding 355 wound around the second leg 332 of the transformer core 320.

The primary winding 345 is wound around both first leg 331 of the transformer core 320 and the first inductor core 321. The primary winding 345 comprises a first loop 345C wound around the first leg 331 of the transformer core 320 and around the first sector 321A of the inductor core 321. The primary winding 345 also comprises a second loop 345D wound around the first leg 331 of the transformer core 320 and around the second sector 321B of the inductor core 321.

The secondary winding 355 comprises a first loop 355C wound around the second leg 332 of the transformer core 320 and around the first sector 322A of the second inductor core 322. The secondary winding 355 also comprises a second loop 355D wound around the second leg 332 of the transformer core 320 and around the second sector 322B of the second inductor core 322. Accordingly, the combined transformer and inductor 103 of FIGS. 8 and 8A has inductances in both the primary winding 345 and the secondary winding 355.

FIG. 8A is a circuit diagram of the combined transformer and inductor 103 shown in FIG. 8. The primary winding 345 comprises a primary transformer winding 345A and a primary inductor winding 345B. It is understood that the primary transformer winding 345A and the primary inductor winding 345B shown in FIG. 8A are in physical reality one and the same as the primary winding 345 comprising the first and second loops 345C and 345D shown in FIG. 8. The primary transformer winding 345A is that portion of the primary winding 345 which is wound about the transformer core 320. The primary inductor winding 345B is that portion of the primary winding 345 which is wound about the first inductor core 321.

The secondary winding 355 comprises the secondary transformer winding 355A and a secondary inductor winding 355B. It is understood that the secondary transformer winding 355A and the secondary inductor winding 355B shown in FIG. 8A are in physical reality one and the same as the secondary winding 355 comprising the first and second loops 355C and 355D shown in FIG. 8. The secondary transformer winding 355A is that portion of the secondary winding 355 which is wound about the transformer core 320. The secondary inductor winding 355B is that portion of the secondary winding 355 which is wound about the second inductor core 322. Accordingly, the combined transformer and inductor 103 of FIGS. 8 and 8A has inductances in the primary winding 345 and the secondary winding 355.

Figure 9:
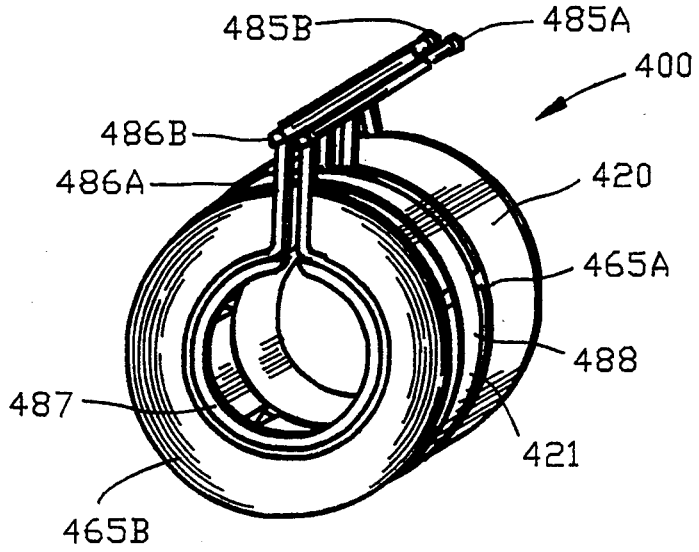
FIG. 9 is an isometric assembled view of a fourth embodiment of a combined transformer and inductor of the present invention.
Figure 10:
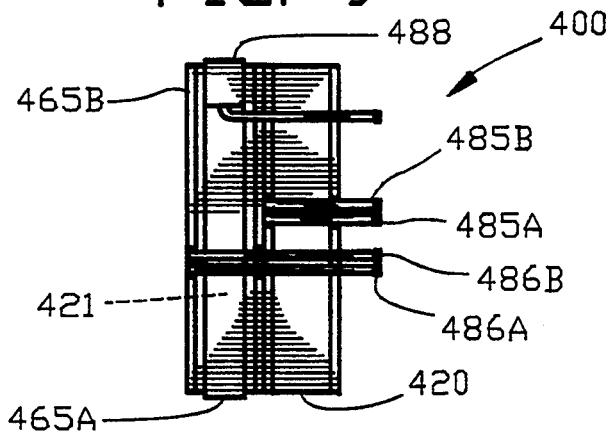
FIG. 10 is a top view of the combined transformer and inductor of FIG. 9.
Figure 11:
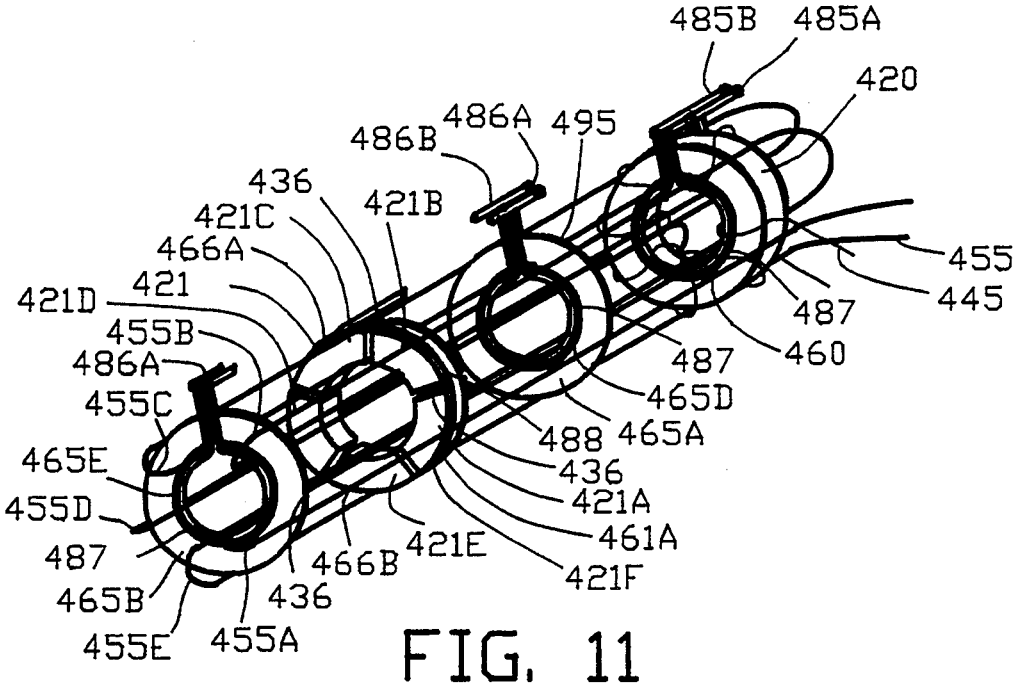
FIG. 11 is an exploded view of FIG. 9.

FIGS. 9–11 depict isometric, top, and exploded views of fourth embodiment of a combined transformer and inductor 400 of the present invention. The combined transformer and inductor 400 comprises a transformer core 420 and an inductor core 421, each being composed of material having high magnetic permeability, such as silicon steel, ferrite material, powder iron, nickel, or the like. The transformer core 420 and the inductor core 421 are toroidal in shape. While a toroidal core is the preferred embodiment, other core designs may be used, including square cores, rectangular cores, E cores, C cores, or other designs as are known in the art.

The inductor core 421 comprises five sectors 421A–421E defining five air gaps 436 interposed therein. It is understood that the number of sectors and the air gaps may vary depending on design specifications. Preferably, the sectors 421A–421E are uniform in cross-section and in separation. A first and second cooling plate 465A and 465B are mounted adjacent a first and second face 466A and 466B, respectively, of the inductor core 421. The transformer core 420 is mounted adjacent a first face 495 of the cooling plate 465B forming a cylindrical assembly.

A first intake coolant tube 485A and a first outlet coolant tube 485B are exteriorly attached and run parallel to a cylindrical axis of the combined transformer and inductor 400. Similarly, a second intake coolant tube 486A and a second outlet coolant tube 486B are exteriorly attached and run parallel to the cylindrical axis of the combined transformer and inductor 400. Coolant tube loops 487 are attached internal and adjacent to an internal surface 460A of the transformer core 420, an internal surface 465D of the first cooling plate 465A and an internal surface 465E of the second cooling plate 465B. Inductor coolant tube loop 488 is attached external and adjacent to an external surface 421F of the inductor core 421. The first intake coolant tube 485A and the first outlet coolant tube 485B are in fluid communication with coolant tube loops 487. The second intake coolant tube 486A and the second outlet coolant tube 486B are in fluid communication with the inductor coolant tube loop 488.

As shown in FIG. 11, a primary winding 445 is wound around transformer core 420. A secondary winding 455 is wound around the assembled transformer core 420, the inductor core 421 and the first and second cooling plates 465A and 465B. The secondary winding 455 comprises five loops 455A–455E wound around the sectors 421A–421E of the inductor core 421. In assembly, care is taken to insure that loops 455A–455E are divided equally around sectors 421A–421E and do not overlie the air gaps 436.

Figure 12:
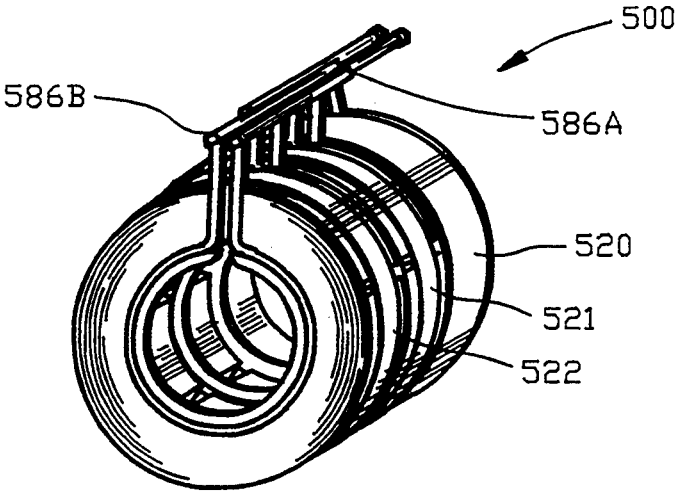
FIG. 12 is an isometric assembled view of a fifth embodiment of a combined transformer and inductor of the present invention.
Figure 13:
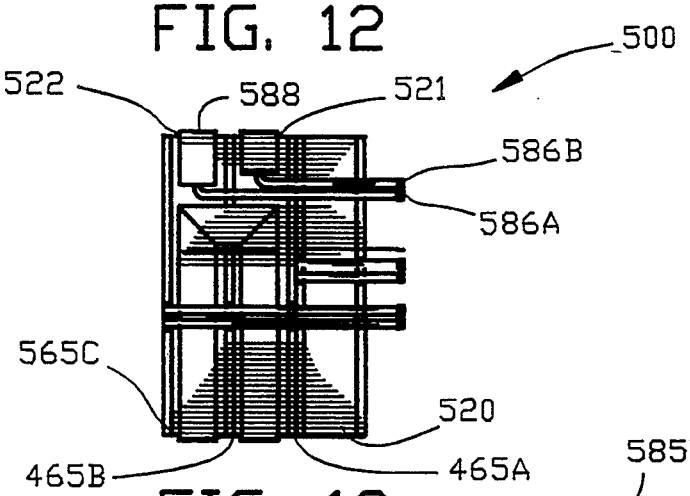
FIG. 13 is a top view of the combined transformer and inductor of FIG. 12.
Figure 14:
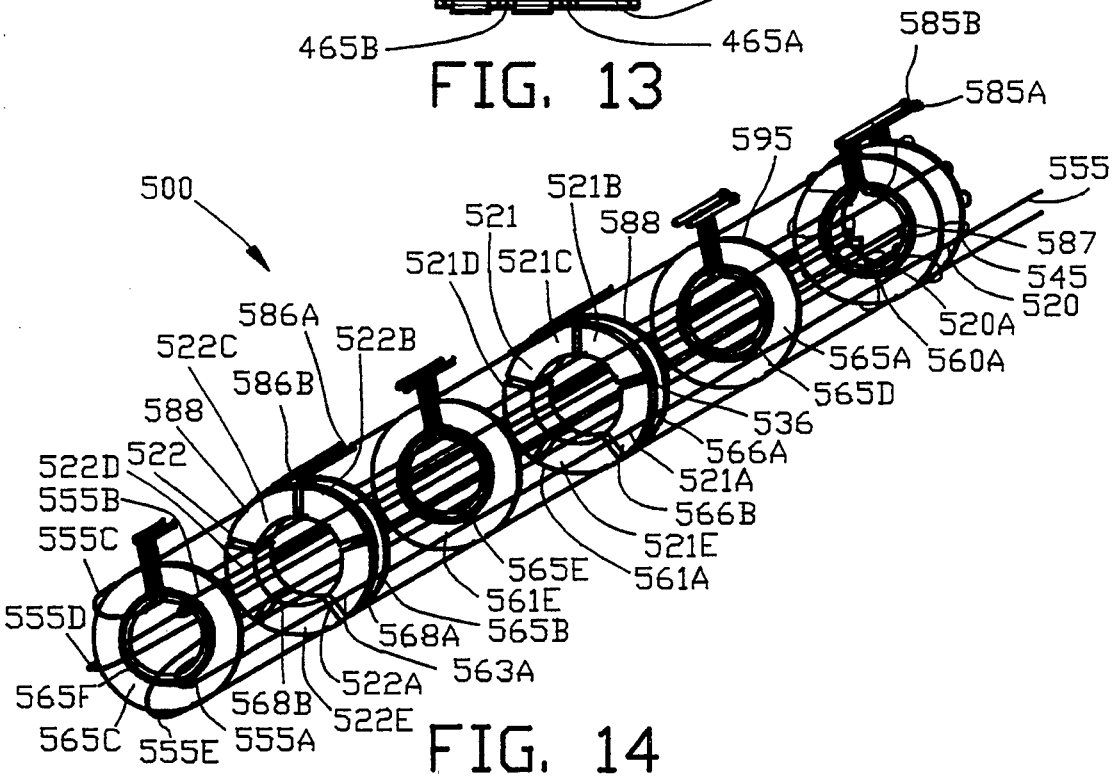
FIG. 14 is an exploded view of FIG. 12.

FIGS. 12–14 depict isometric, top, and exploded views of a fourth embodiment of a combined transformer and inductor 500 of the present invention. The combined transformer and inductor 500 comprises a transformer core 520 and a first and second inductor core 521 and 522, each being toroidal in shape. The first and second inductor cores 521 and 522 each comprises five sectors, 521A–521E and 522A–522E respectively, defining five air gaps 536 interposed in each of the first and second inductor cores 521 and 522. It is understood that the number of sectors and air gaps may vary depending on design specifications. Preferably, sectors 521A–521E and 522A–522E are uniform in size and spacing. A first and second cooling plate 565A and 565B are mounted adjacent a first and second face 566A and 566B, respectively, of the first inductor core 521. The second cooling plate 565B and a third cooling plate 565C are mounted adjacent a first and second face 568A and 568B, respectively, of the second inductor core 522. The transformer core 520 is mounted adjacent a first face 595 of first cooling plate 565A.

A first intake coolant tube 585A and a first outlet coolant tube 585B are exteriorly attached and run parallel to the cylindrical axis of the combined transformer and inductor 500. Similarly, a second intake coolant tube 586A and a second outlet coolant tube 586B are exteriorly attached and run parallel to the cylindrical axis of the combined transformer and inductor 500. Coolant tube loops 587 are attached internal and adjacent to an internal surface 560A of transformer core 520, an internal surface 565D of first cooling plate 565A, an internal surface 565E of second cooling plate 565B and an internal surface 565F of third cooling plate 565C. Inductor coolant tube loop 588 is attached external and adjacent to an external surfaces 561A and 563A of first and second inductor cores 521 and 522, respectively. First intake coolant tube 585A and first outlet coolant tube 585B are in fluid communication with coolant tube loops 587. Second intake coolant tube 586A and second outlet coolant tube 586B are in fluid communication with first and second inductor coolant tube loops 588.

As shown in FIG. 14, a secondary winding 555 is wound around transformer core 520. A primary winding 545 is wound around the assembled transformer core 520, first and second inductor cores 521 and 522, and first, second and third cooling plates 565A–565C. Primary winding 545 comprises five loop 555A–555E wound around sectors 521A–521E of first inductor core 521 and around sectors 522A–522E of second inductor core 522. In assembly, care is taken to insure that loops 555A–555E are divided equally around sectors 521A–521E and 522A–522E and do not overlie air gaps 536.

Figure 15:
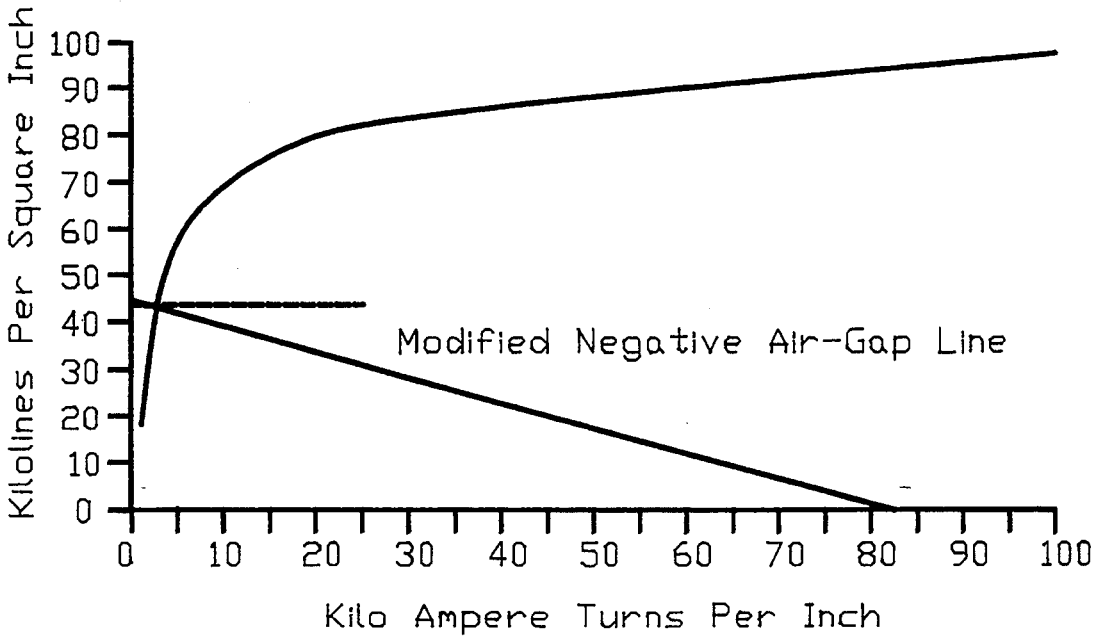
FIG. 15 is a graph of the magnetic flux density in the inductor core as a function of ampere turns per inch of the inductor.
Figure 16:
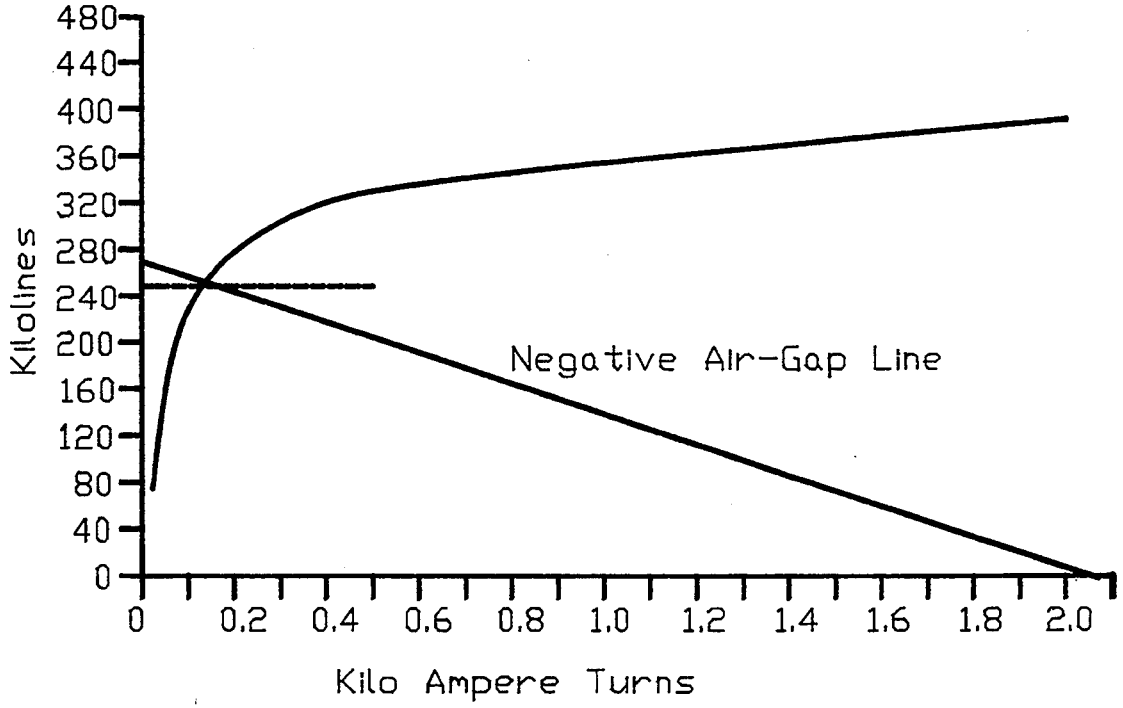
FIG. 16 is a graph of magnetic flux in an air gap as a function of the ampere turns per inch of the inductor in FIG. 15.

FIGS. 15 and 16 illustrate the relationship between the magnetic flux and the ampere turns of an inductor having an air gap as taught by the prior art publication entitled "Magnetic Circuits and Transformers," EE Staff MIT, Eighth printing, 1952, pages 54–84, 228,323 and 313–366. FIG. 15 is a graph illustrating the relationship between the flux density in kilolines per square inch in an inductor as a function of the ampere turns per inch in the magnetic path of the inductor. FIG. 16 is a graph illustrating the relationship between the flux in kilolines in the air gap of the inductor as a function of the ampere turns in the inductor of FIG. 15. The prior art used the graphs of FIGS. 15 and 16 to design both transformers and inductors. In the case of an inductor having an air gap, the prior art considered the cross-sectional area of the air gap to be twice the actual cross-sectional area of the air gap in order to compensate for the losses due to the fringing flux. Accordingly, the above practice was inadequate for designing combined transformers and inductors for use at high power levels and/or for use at high operating frequencies.

The present invention includes many advantages and features over the prior art. In the prior art design of FIGS. 1 and 2, when a current is applied to a primary winding 45, a magnetic flux is induced in first leg 31 of the core 30. The magnetic flux flows about the transformer core 30 through the second leg 32 of the core 30. The flux passing through second leg 32 induces a current in the secondary winding 55.

In addition, the air gap 36 of the fifth leg 35, being composed of air rather than ferromagnetic material, has a greater reluctance than the ferromagnetic core 30. As such, an inductance is created in the secondary inductor winding 55B. When a small air gap 70 is interposed in the ferromagnetic material 74 as shown in FIG. 3, the magnetic flux 75 crosses the expanse of small air gap 70 without significant loss. When a large air gap 70A is interposed in the ferromagnetic material 74A as shown in FIG. 4, a fringing or leakage flux 77A begins to occur on the outer peripheries. This leakage flux 77A results in heating of the ferromagnetic material 74A which is an undesirable feature.

The present invention incorporates a plurality of air gaps distributed about a separate inductor core for reducing fringing flux and flux leakage and for distributing heat about the inductor core as demonstrated in FIGS. 5A–5C.

In FIGS. 9–11, five air gaps 436 are utilized to reduced fringing flux and flux leakage and for distributing heat about the inductor core relative to prior art designs. In addition, heat is further dissipated through the cooling plates 465A and 465B, the cooling loops 465D, 465E and 487 and the inductor coolant tube loop 488. A liquid coolant (not shown) such as water or other coolant, is introduced into first intake coolant tube 485A. The liquid coolant flows through the first intake coolant tube 485A into the coolant tube loops 487, thereby cooling the internal surface 465D of the first cooling plate 465A, the internal surface 465E of the second cooling plate 465B, and the internal surface of transformer core 420. The first and second cooling plates 465A and 465B in turn cool the first and second face 466A and 466B of the inductor core 421 and the transformer core 420 adjacent to first face 495 of the cooling plate 465A. The first outlet coolant tube 485B is in fluid communication with the coolant tube loops 487, and conducts liquid coolant away from the combined transformer and inductor 400. A liquid coolant (not shown) is simultaneously introduced into second intake coolant tube 486A. Liquid coolant flows through the second intake coolant tube 486A into the inductor coolant tube loop 488, thereby cooling external surface 461A of the inductor core 421. The second outlet coolant tube 486B are in fluid communication with inductor coolant tube loop 488, and conducts liquid coolant away from device 400.

In a similar manner as shown in FIG. 12–14, the leakage flux generated across five air gaps 536 of the first inductor core 521 and five air gaps of second inductor core 522 is greatly reduced relative to prior art designs. The heat generated in the first and second inductor cores 521 and 522 is similarly greatly reduced. Primary winding 555 has an equal or nearly equal number of loops 555A–555E wound around each sector 521A–521E and 522A–522E, in order to insure that a different amount of flux is not induced in each sector 521A–521E and 522A–522E.

In addition, heat is further dissipated through the first, second and third cooling plates 565A–565C, the cooling loops 565D, 565E, 565F and 587, and the inductor coolant tube loops 588. A liquid coolant (not shown) is introduced into the first intake coolant tube 585A and flows through the first intake coolant tube 585A into the coolant tube loops 587 thereby cooling the internal surface 560A of the transformer core 520, the internal surface 565D of the first cooling plate 565A, the internal surface 565E of the second cooling plate 565B and the internal surface 565F of the third cooling plate 565C. First, second and third cooling plates 565A–565C in turn cool a first and second face 566A and 566B, respectively, of the first inductor core 521, the transformer core 520 mounted adjacent first face 595 of the first cooling plate 465A. The first outlet coolant tube 585B is in fluid communication with coolant tube loops 587, and conducts liquid coolant away from combined transformer and inductor 500. A liquid coolant (not shown) is simultaneously introduced into second intake coolant tube 586A. The liquid coolant flows through second intake coolant tube 586A into first and second inductor coolant tube loops 588, thereby cooling external surfaces 561A and 563A of first and second inductor cores 521 and 522, respectively. Second outlet coolant tube 586B is in fluid communication with first and second inductor coolant tube loops 588, and conducts liquid coolant away from device 500.

By thus utilizing multiple inductor cores 521 and 522, and thereby further increasing the number of air gaps 536, the gap length of each air gap 536 can be reduced. This reduces leakage flux while maintaining the desired inductance. The result is less heating and more accurate design calculations regarding gap losses allowing more accurate construction of a combined transformer and inductor.

Furthermore, the above designs are not limited to isolation transformers but can be applied to other types of transformers including autotransformers, zig-zag transformers, Scott connected transformers, and the like operating in a single or multiphase. The combined transformer and inductor may operate at frequencies from a few cycles to 200–300 KHZ at power levels from a few volt-amperes to thousands of kilo-volt amperes.

The present invention is ideally suited for use in resonant circuits, in current limiting circuits, switching power supplies and similar applications having high power and/or high frequency requirements. Such high power circuits create thousands of kilolines of magnetic flux around the core, and create serious heating and localized overheated regions unless the heat is properly distributed about the core. The proper cooling of the core material and the windings must be provided or the device will be subjected to thermal decomposition.

In contrast to the prior art practice of using the graphs of FIGS. 15 and 16 for designing a combined transformer and inductor, the present invention utilizes the following parameters for providing a combined transformer and inductor for use at high power levels and/or for use at high operating frequencies.

EXAMPLE

The total gap length $L_g$ is calculated by the following formula:

$$L_g = [3.19 \times 10^{-8}] * S * N^2 * \frac{A}{L_{ac}}$$

where

S is the core stacking factor

N is the number of turns around each core section

A is the area of the air gap, $L_{ac}$ is the input inductance,

If the stacking factor [S] of the core is 0.95, the number of turns [N] is 8, the area of the air gap [A] is 11.6 square inches, and the desired input inductance is $30 \times 10^{-6}$ H, then the theoretical air gap required can be calculated as follows:

$$L_g = [3.19 \times 10^{-8}] * [0.95] * 8^2 * \frac{11.6}{30 \times 10^{-6}}$$

Therefore, the theoretical air gap required:

$$L_g = 0.75 \text{ inches}$$

This calculation does not consider the fringing flux. In contrast to the prior art practice of doubling the cross-sectional area [A] of the air gap, the present invention is constructed using the actual cross-sectional area [A] of the air gap and calculates the fringing flux $F_f$ as follows:

$$F_f = \frac{1 + L_g}{\sqrt{A}} * \ln \frac{2G}{L_g}$$

where $L_g$ is the total gap length

A is the area of the air gap,

G is the height of the core,

Assuming that the height of the core is 4.2 inches, the actual air gap required is calculated as follows:

$$F_f = \frac{1 + 0.75}{\sqrt{11.6}} * \ln \frac{4.20}{0.75}$$

$$F_f = 1.237$$

Therefore, the actual air gap $L_a$ required is:

$$L_a = L_g * F_f = 1.237 * 0.75$$

$$L_a = 0.93 \text{ inches}$$

In order to provide a combined transformer and inductor to have an inductance of 30 μH, a theoretical air gap of 0.75inches was required as calculated above. However, an actual air gap of 0.93 inches was required due to the fringing flux.

In addition to the above, the present invention utilizes the following parameters for providing a combined transformer and inductor for use at high power levels and/or for use at high operating frequencies. First, the maximum allowable air gap length is 0.25 inches and is preferably, 0.125 inches to 0,188 inches. Accordingly, the number of the air gaps are increased in order to satisfy this maximum air gap length restriction. Second, the losses at each of a plurality of air gaps of the inductor is restricted to be less than 30.0 watts per square inch for a water cooled inductor. The losses at each of a plurality of air gaps of the inductor is restricted to be less than 2.0 watts per square inch for an air cooled inductor. Third, each sector of the inductor core should have an equal number of turns. In the event that each sector of the inductor core cannot have an equal number of turns, then the turns may be arranged in a parallel relationship to provide an equal number of ampere turns per sector.

In an actual construction of the combined transformer and inductor calculated above, two inductor cores were utilized with each inductor core having six (6) air gaps at 0.155 inches per air gap. The total of twelve (12) air gaps yielded a calculated theoretical inductance of 24.12 μH. The calculated actual inductance of 29.91 μH was calculates as follows:

$$24.12\ \mu\text{H} * \frac{0.93}{0.75} = 29.91\ \mu\text{H}$$

After the combined transformer and inductor was fabricated, the inductance measured inductance was 29.94 μH. Since the present invention reduces the fringing flux, a transformer can be designed and constructed to be more approximate the theoretical design. In accordance with the teaching of the present invention, the number of inductor winding turns is minimized as to reduce the ampere turns. Ideally there should be one gap per winding turn although this is not practical in most cases, especially at low frequencies.

For example, four air gaps each having a length of 0.25 inches results in a flux leakage of less than 25% of the flux leakage generated at a single 1.0 inch gap length. Likewise, the heat generated in the inductor core is cumulatively less through the use of multiple air gaps. Accordingly, not only is the heat more evenly distributed about the core, but the total heat generated is actually less. The reduction in the core heating therefore allows for the construction of smaller and less expensive transformers for the same power level.

The present invention has numerous advantages over the prior art. The present invention provides a more uniform distribution of heat about the inductor core which is easier to dissipate. The leakage or fringing flux is substantially reduced allowing for the more accurate calculation of the amount of heat generated at the air gap. Accordingly, a more accurate transformer can be designed with multiple air gaps.

In addition to reduced heating of the inductor core, the reduced leakage flux resulting from the smaller air gap lengths has the benefit of allowing more accurate transformer designs. The smaller air gaps provides a lower fringing flux at each of the air gaps enabling a more accurate calculation of the air gap losses, the total losses, number of air gaps required and the air gap length.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A combined transformer and inductor for transmitting power between a source and a load, comprising:

a transformer core;

a primary winding wound about said transformer core;

primary connector means for electrically connecting said primary winding to the source;

a secondary winding wound about said transformer core;

secondary connector means for electrically connecting said secondary winding to the load;

an inductor core means being magnetically independent from said transformer core;

an inductor coil means wound about said inductor core means;

said inductor coil means comprising a plurality of inductor winding loops being interposed in series with at least one of said primary winding and said secondary windings;

each of said plurality of inductor winding loops having a substantially equal number of winding turns;

a plurality of air gaps interposed in said inductor core means for providing an inductance in said one of said primary winding and said secondary windings;

said plurality of air gaps being uniformly distributed about said inductor core means defining a plurality of substantially equal sectors;

each of said plurality of air gaps having a uniform gap length and being interposed at equal distances about said inductor core means; and said plurality of inductor winding loops being substantially centrally disposed within each of said plurality of inductor core sectors and avoiding overlying each of said plurality of air gaps for uniformly distributing heat generated at said plurality of air gaps about said inductor core means.

2. A combined transformer and inductor as set forth in claim 1, wherein said inductor coil means is interposed in series with said primary winding.

3. A combined transformer and inductor as set forth in claim 1, wherein said inductor coil means is interposed in series with said secondary winding.

4. A combined transformer and inductor as set forth in claim 1, wherein said inductor coil means is interposed in series with said primary winding and interposed in series with said secondary winding.

5. A combined transformer and inductor as set forth in claim 1, wherein said inductor coil means is unitarily wound with at least one of said primary winding and said secondary windings.

6. A combined transformer and inductor as set forth in claim 1, wherein each of said plurality of air gaps has a gap flux and a leakage flux across an air gap length; and said plurality of air gaps being of a sufficient number to reduce said air gap length to less than 0.25 inches in each of said plurality of air gaps.

7. A combined transformer and inductor as set forth in claim 1, including cooling means for cooling said inductor core means.

8. A combined transformer and inductor as set forth in claim 1, including a water cooled jacket in thermal contact with said inductor core means for cooling said inductor core means.

9. A combined transformer and inductor as set forth in claim 1, including a water cooled jacket in thermal contact with said inductor core means for cooling said inductor core means; and said water cooled jacket comprising a first and a second water-cooled plate disposed on a first and a second side of said inductor core means.

10. A combined transformer and inductor for transmitting power between a source and a load, comprising:

a continuous magnetic path transformer core;

a primary winding wound about said continuous magnetic path transformer core;

primary connector means for electrically connecting said primary winding to the source;

a secondary winding wound about said continuous magnetic path transformer core;

11. A combined transformer and inductor for transmitting power between a source and a load, comprising:

a continuous magnetic path transformer core;

a primary winding wound about said continuous magnetic path transformer core;

primary connector means for electrically connecting said primary winding to the source;

a secondary winding wound about said continuous magnetic path transformer core;

secondary connector means for electrically connecting said secondary winding to the load;

a continuous magnetic path inductor core means;

said continuous magnetic path inductor core means being disposed in a stacked relationship with said continuous magnetic path transformer core and being magnetically independent therefrom;

at least one of said primary and secondary windings being wound about said continuous magnetic path inductor core means;

a plurality of air gaps uniformly distributed in said continuous magnetic path inductor core means for providing an inductance in said one of said primary windings and said secondary windings and for uniformly distributing heat generated at said plurality of air gaps about said continuous magnetic path inductor core means;

each of said plurality of air gaps having a gap flux and a leakage flux across an air length;

said plurality of air gaps being of a sufficient number to reduce said air gap length to be less than 0.25 inches in each of said plurality of air gaps;

said continuous magnetic path transformer core and said continuous magnetic path inductor core means are toroidal;

said stacked relationship of said continuous magnetic path inductor core means and said continuous magnetic path transformer core forms a cylindrical core stack;

a water cooled jacket in thermal contact with said cylindrical core stack for cooling said cylindrical core stack;

said water cooled jacket comprising a first and a second water-cooled plate disposed on a first and a second side of said cylindrical core stack; and said water cooled jacket further comprising a cylindrical wrap disposed on a cylindrical surface of said cylindrical core stack.

12. A combined transformer and inductor as set forth in claim 11, including cooling means for cooling said cylindrical core stack.

13. A combined transformer and inductor as set forth in claim 11, including a water cooled jacket in thermal contact with said cylindrical core stack for cooling said cylindrical core stack.

* * * * *

UNITED STATES PATENT AND TRADEMARK OFFICE

CERTIFICATE OF CORRECTION

PATENT NO. : 5,376,912

DATED : December 27, 1994

INVENTOR(S) : Casagrande

It is certified that error appears in the above-identified patent and that said Letters Patent is hereby corrected as shown below:

Column 14, line 41, delete "0,188" and insert --0.188--.

Column 16, line 56,

Claim 10, after "core;" (last occurrence) insert the following:

UNITED STATES PATENT AND TRADEMARK OFFICE

CERTIFICATE OF CORRECTION

PATENT NO. : 5,376,912

DATED : December 27, 1994

INVENTOR(S) : Casagrande

It is certified that error appears in the above-identified patent and that said Letters Patent is hereby corrected as shown below:

secondary connector means for electrically connecting said secondary winding to the load;

a continuous magnetic path inductor core means;

said continuous magnetic path inductor core means being disposed in a stacked relationship with said continuous magnetic path transformer core and being magnetically independent therefrom;

at least one of said primary and secondary windings being wound about said continuous magnetic path inductor core means defining inductor coil means;

said inductor coil means comprising a plurality of inductor winding loops with each of said plurality of inductor winding loops having a substantially equal number of winding turns;

a plurality of air gaps uniformly distributed in said continuous magnetic path inductor core means defining a plurality of equal sectors for providing an inductance in said one of said primary windings and said secondary windings;

each of said plurality of air gaps having a uniform gap length and being interposed at equal distances about said inductor core means;

said plurality of inductor winding loops being substantially centrally disposed within each of said plurality of inductor core sectors and avoiding overlying each of said plurality of air gaps for uniformly distributing heat generated at said plurality of air gaps about said continuous magnetic path inductor core means;

UNITED STATES PATENT AND TRADEMARK OFFICE

CERTIFICATE OF CORRECTION

PATENT NO. : 5,376,912

DATED : December 27, 1994

INVENTOR(S) : Casagrande

It is certified that error appears in the above-identified patent and that said Letters Patent is hereby corrected as shown below:

each of said plurality of air gaps having a gap flux and a leakage flux across an air gap length; and said plurality of air gaps being of a sufficient number to reduce said air gap length to be less than 0.25 inches in each of said plurality of air gaps.

Signed and Sealed this

Twenty-fifth Day of April, 1995

*Attest:*

Bruce Lehman

BRUCE LEHMAN

*Attesting Officer*

*Commissioner of Patents and Trademarks*